United States Patent [19]

Sandow

[11] Patent Number: 4,723,386

[45] Date of Patent: Feb. 9, 1988

[54] VAULTED SKYLIGHT PANEL APPARATUS

[75] Inventor: Kiyoshi Sandow, Crosby, Tex.

[73] Assignee: Plasteco, Inc., Houston, Tex.

[21] Appl. No.: 906,803

[22] Filed: Sep. 12, 1986

[51] Int. Cl.[4] ..... E04B 7/18

[52] U.S. Cl. ..... 52/200; 52/86

[58] Field of Search ..... 52/86, 200

[56] References Cited

U.S. PATENT DOCUMENTS

| | | | |
|---|---|---|---|
| 3,762,120 | 10/1973 | Janssen | 52/200 |
| 4,428,169 | 1/1984 | Tsakiris | 52/200 |
| 4,441,291 | 4/1984 | Sokoler | 52/200 |
| 4,539,783 | 9/1985 | O'Keeffe | 52/200 |
| 4,569,166 | 2/1986 | Buchmüller | 52/200 |
| 4,587,776 | 5/1986 | Leurent | 52/200 |

FOREIGN PATENT DOCUMENTS

| | | | |
|---|---|---|---|
| 2036158 | 12/1970 | France | 52/200 |

*Primary Examiner*—Henry E. Raduazo

*Attorney, Agent, or Firm*—Pravel, Gambrell, Hewitt, Kimball & Krieger

[57] ABSTRACT

A vaulted skylight apparatus provides modular skylight panel having a pair of first and second spaced apart, generally parallel, sheets of flexible material with an insulating air space therebetween. The modular panel can be curved by cold forming so that the panels can conform to a network of structural tubing, forming a quarter round vault, a half round vault, a structural barrel vault, or the like. The sheets are supported peripherally by a frame which includes first and second frame members that are affixed respectively to the first and second panels forming a seal therewith. The first and second frame members are movably connected, holding the first and second frame members together during simultaneous cold forming of the first and second sheets into the desired curved vaulted position as aforedescribed.

10 Claims, 16 Drawing Figures

VAULTED SKYLIGHT PANEL APPARATUS

BACKGROUND OF THE INVENTION

The present invention relates to structural skylights such as acrylic or other types of plastic sheet skylights which have curved panes or panels forming to an underlying support frame of structural aluminum, for example. More particularly, the present invention relates to a vaulted skylight constructed of modular panels wherein spaced apart inner and outer sheets of each modular panel are peripherally connected to isolate an air space therebetween yet allow relative movement between the inner and outer sheets when the sheets are simultaneously cold formed into an arc during placement upon the underlying structural support frame. Further, the present invention relates to a composite skylight construction of light-transmitting panels and underlying support structure which is quickly field-assembled without the use of a plurality of individual fasteners and the attending manual labor.

Vaulted skylights are constructed of a composite that, for example, includes panes of acrylic supported by a structural frame of aluminum. The panes and frame can form various curved cross-sectional shapes, e.g., half round vaults, quarter round vaults, and barrel vaults. These curved shapes are typically defined by the rigid structural frame of pre-shaped structural aluminum tubing. Translucent or transparent panels of acrylic may cover the tubing frame to form a roof or watertight enclosure which admits sunlight. The acrylic sheets are normally cold formed to the tubing frame during installation and are held in place using clamps or straps. The structural tubing frame can be supported by a curb rail which rests upon an underlying foundation such as a brick wall, concrete curb, timber frame, or the like.

Vaulted structural skylights often feature two or more parallel plastic panels which are separated by a small distance (e.g., ½"-1") to provide an insulating airspace therebetween. For an enclosure covered by the skylight, which uses a heating or air-conditioning system, the double panes contribute to energy conservation. Skylights using two or more spaced, parallel plastic sheets require field assembly of a first sheet layer and thereafter the addition of the second sheet layer. Such field assembly typically employs a large number of closely spaced apart fasteners such as sheet metal screws, rivets or the like which must be manually installed. An installer must climb upon the aluminum support frame after each panel is properly positioned and fasten the screws or rivets one at a time. This piecemeal field assembly of multiple pane or sheet layers creates a number of problems. The assembly of two individual sheets is a complicated and expensive installation. The facing inner surfaces of the two panels are often subjected to damage by scratching, for example. Dust, pollen, and other airborn debris can accumulate on the inner surfaces of the layers when the sheet layers are assembled separately (on site) upon the supporting structural frame.

Some attempts have been made to eliminate the use of a multitude of fasteners such as sheets metal screws and/or rivets. For example, the Jansen U.S. Pat. No. 3,762,120 provides a skylight device wherein two filling panels or partitions are provided. However, this patent describes a sequential installation of the underlying or lower panel followed by the on-site installation of the second panel. The Jansen patent suffers from the aforedescribed problems of dust accumulation, complicated on-site installation and the danger of damage to inside surfaces of the panels.

Other prior art devices contemplate the use of preformed or preshaped panels which are either factory assembled or field assembled. Such panels are typically preformed prior to assembly on-site. This type of construction causes problems in that the pre-formed or precurved skylight panels are not easily and economically transportable to the job site because of excessive space requirements.

SUMMARY OF THE INVENTION

The present invention solves these problems and shortcomings in a simple, straightforward manner by providing a modular panel vaulted skylight apparatus which is preassembled of multiple light-transmitting panels which can be subsequently and simultaneously cold formed to a structural support frame in the field, eliminating excess fasteners and the danger of panel surface damage. The present invention thus provides a modular skylight panel having two or more sheets of a suitable plastic material such as acrylic which are separated by, for example, one half to one inches (½"-1") of airspace and joined at the perimeter of the sheets with a peripheral frame. The frame includes first and second frame members and a connection for holding the first and second frame members together during simultaneous cold forming of the first and second sheets into a curved, vaulted position. These panels can be factory contructed as complete units with enclosed airspaces between the panels and then easily field installed to form half round, quarter round, or barrel shaped skylights. The peripheral frame allows relative movement between the outer and inner panel sheets which naturally occurs when the entire modular panel of the present invention is cold formed to the curvature of an underlying vaulted skylight structural support frame and without substantially changing the distance between the panels. The present invention thus offers advantages over the conventional technique for installing double sheet vaulted skylights, namely (1) faster, less complicated installation, i.e., one panel versus two individual sheets; and (2) the prevention of permanent, visible damage such as scratching and dust accumulation on the inner surfaces of the layers that can occur when the layers are assembled separately (on-site) upon an underlying structural frame.

The present invention provides an apparatus which speeds installation by eliminating the need to climb on the exterior of the skylight to install screws, rivets or like fasteners, thus speeding and simplifying field assembly.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF A PREFERRED EMBODIMENT

Figure 2:
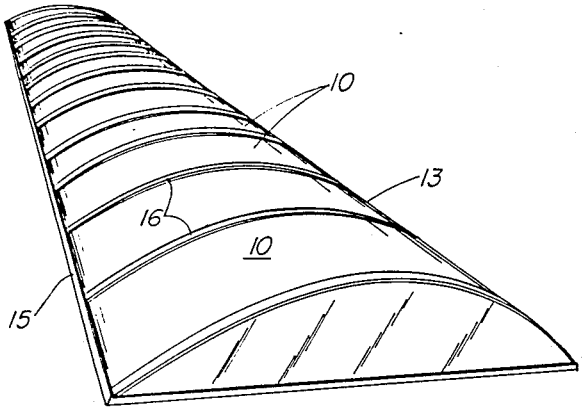
FIG. 2 is a perspective view of the preferred embodiment of the apparatus of the present invention showing a structural barrel vault.
Figure 1:
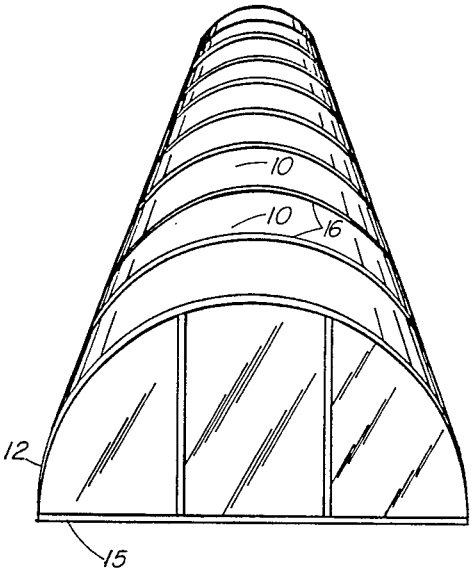
FIG. 1 is a perspective view of the preferred embodiment of the apparatus of the present invention illustrating its use in a half round vault.
Figure 3:
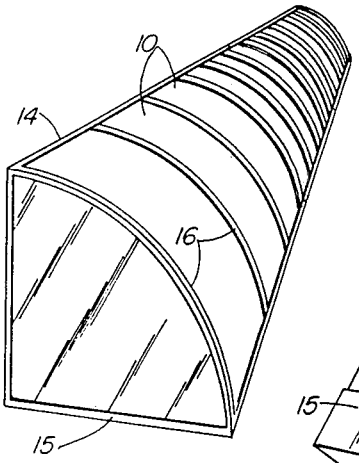
FIG. 3 is a perspective view of the preferred embodiment of the apparatus of the present invention illustrating a quarter round vault.
Figure 4:
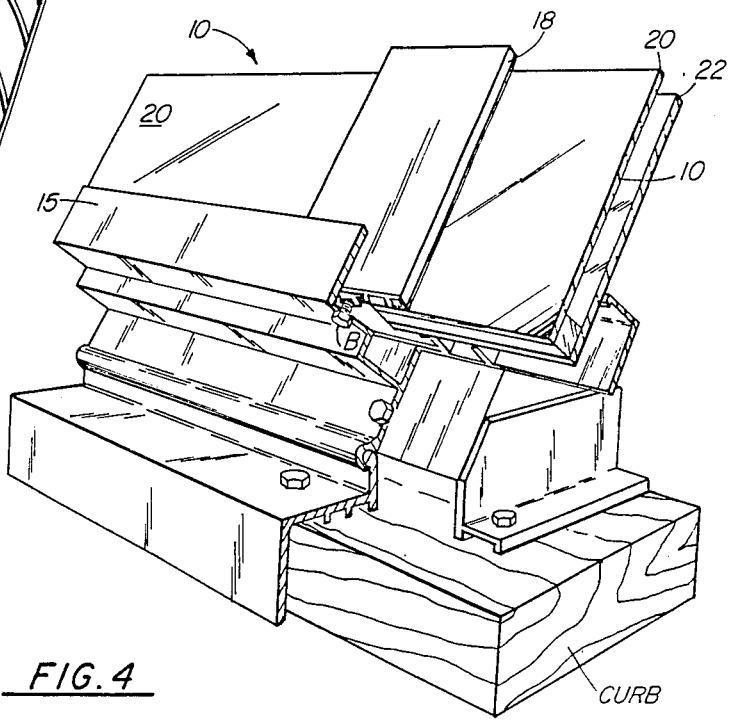
FIG. 4 is a perspective, fragmentary view of the preferred embodiment of the apparatus of the present invention showing two adjacent modular panels, the underlying support frame and the assembly strap.
Figure 5:
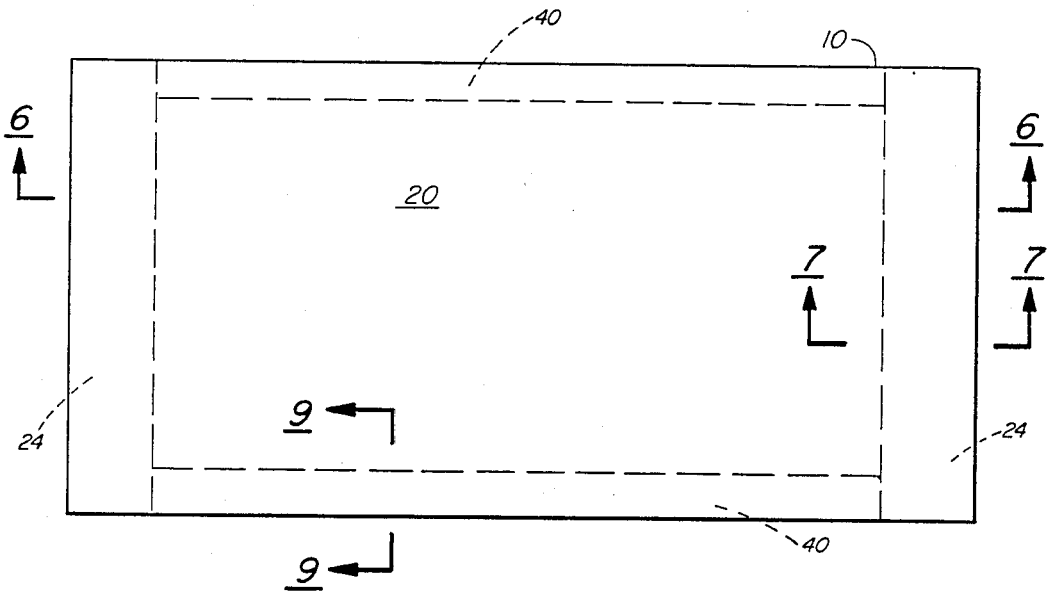
FIG. 5 is a plan view of the preferred embodiment of the apparatus of the present invention showing the modular panel.
Figure 14:
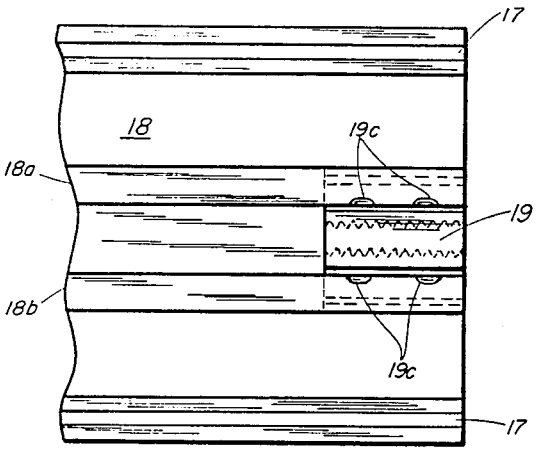
FIG. 14 is a plan view of the clamp bar portion of the preferred embodiment of the apparatus of the present invention.

FIGS. 1–9 illustrate the preferred embodiment of the apparatus of the present invention designated generally by the numeral 10. In FIGS. 1–3 there can be seen respectively a half round vault construction 12 (FIG. 1), a structural barrel vault construction 13 (FIG. 2), and a quarter round vault 14 (FIG. 3). Each vaulted skylight 12–14 includes a perimeter curb rail 15 and a plurality of curved structural tubing supports 16. Modular panels 10 each have two spaced apart sheets which are simultaneously cold formed and affixed to structural tub members 16 using clamp bar 18 (FIG. 14).

Figure 6:
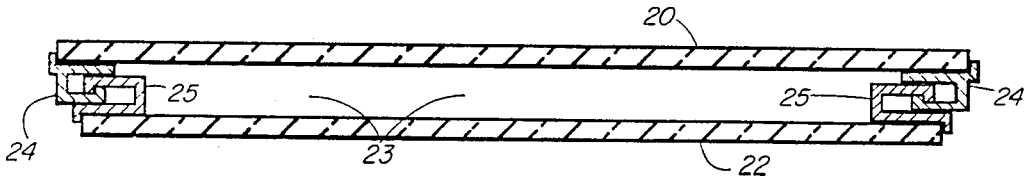
FIG. 6 is a sectional view taken along lines 6—6 of FIG. 5.
Figure 6A:
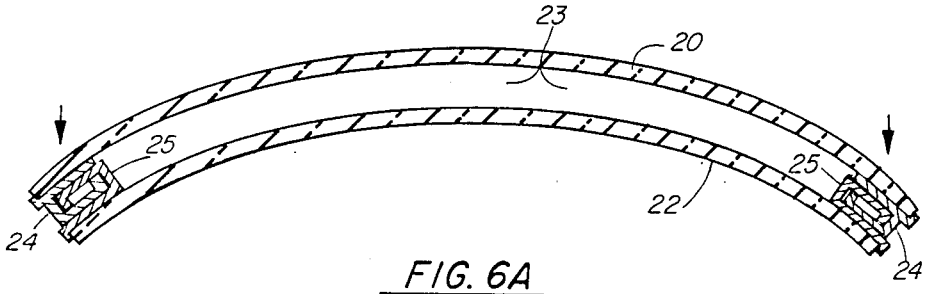
FIG. 6A is a sectional view taken along lines 6—6 of FIG. 5 during cold forming of the panel to a curved shape.

As best seen in FIGS. 4–9, each modular panel 10 includes a pair of spaced apart, generally parallel sheets 20, 22 with an airspace 23 therebetween. Sheets 20, 22 are generally parallel but can be curved by cold forming (FIG. 6A), thus conforming to the half round, quarter round, or structural barrel configuration of a particular underlying support frame of tubing as illustrated in FIGS. 1, 2, and 3. During such cold forming, the outer 20 and inner 22 sheets can move with respect to each other. Outer sheet 20 is preferably dimensioned longer than inner sheet 22 (FIG. 6). Sheets 20, 22 are preferably of equal width. This dimensioning accommodates the differences in arc distance when the panels 20, 22 are cold formed (i.e., bent) into the desired curved shape shown in FIGS. 1–3 of the drawings.

Panels 20, 22 (FIGS. 7–9) are peripherally connected by peripheral, interlocking frame members 24, 25. Sheet 20 is joined by chemical bonding, for example, at 26 to member 24 while sheet 22 is chemically bonded, for example, at 27 to member 25. Other suitable fasteners such as double face adhesive tape can be used to join each sheet 20, 22 to frame members 24, 25. Each peripheral frame member 24, 25 is generally U-shaped. Frame member 24 includes flange 28 which abuts sheet 20, flange 29 which is spaced from but parallel to flange 28 and a connecting vertical web 30. Similarly, frame member 25 includes a base flange 31, a spaced apart parallel flange 32 and a vertical web 33. Each flange 29, 32 carries a stop 34, 35 respectively which abut to define the resting position (FIGS. 6, 7) of each sheet 20, 22 prior to cold forming. Each stop 34, 35 contacts a vertical web 30, 33 after panel 10 is cold formed into an arcuate shape such as is shown in FIGS. 1, 2, 3, 6A, and 8.

Figure 7:
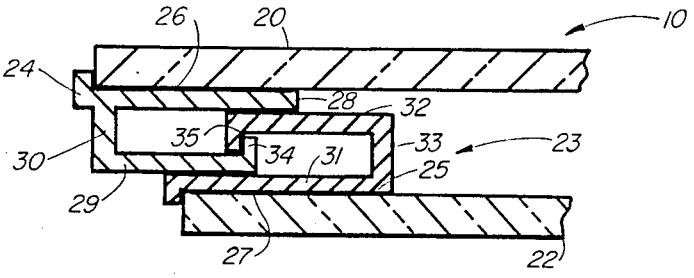
FIG. 7 is a detailed sectional, fragmentary view of the apparatus of the present invention illustrating the modular panel in a rest, flat position.

Since flanges 28, 29, 31 and 32 interlock as shown in FIG. 7, a peripheral seal is formed which inhibits the accumulation of debris, dust and the like within airspace 23. Similarly, the side of each panel 10 (FIG. 9) includes peripheral interlocking side frame members 40, 45 which prevent the inadvertent accumulation of debris within airspace 23. Frame member 40 is preferably continuous with frame member 24. Similarly, frame member 42 is preferably continuous with frame member 25. The frame member 40 includes an innermost flange 41 that is joined by chemical bonding, for example, to sheet 20. Flange 42 is spaced from and parallel to flange 41. Flanges 41, 42 are connected with vertical web 43. Similarly, peripheral frame member 45 includes flange 46, flange 47 and connecting vertical web 48. Flange 46 is preferably bonded by chemical bonding, for example, to sheet 22.

Figure 8:
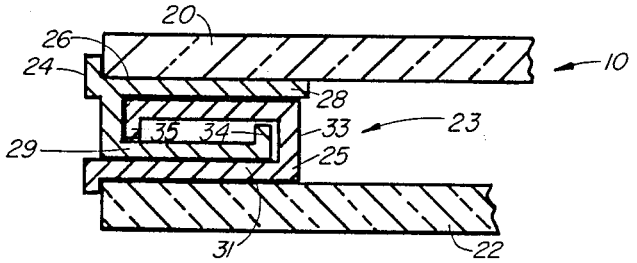
FIG. 8 is a detailed sectional, fragmentary view of the preferred embodiment of the apparatus of the present invention illustrating the peripheral frame after cold forming of the modular panel to a curved shape.
Figure 9:
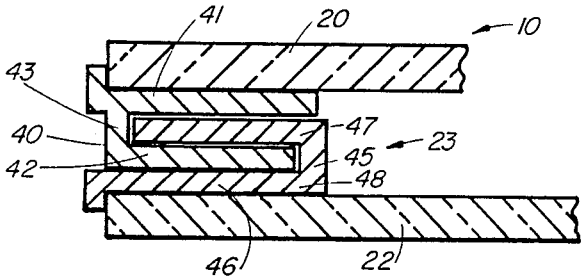
FIG. 9 is a sectional view taken along lines 9—9 of FIG. 5.

One skilled in the art will recognize that peripheral frame members 24, 25 can slide upon each other as shown in FIGS. 7–8. Similarly, the side peripheral frame members 40, 45 can slide with respect to one another.

Sheets 20, 22 are preferably a suitable plastic material such as an acrylic. Peripheral frame members 24, 25 and 40, 45 can similarly be of a plastic material such as polyvinylchloride (PVC), polybutylene, polystyrene, or the like. Structural tubing frame 16 and curb rail 15 can be, for example, any suitable structural material such as, for example, structural aluminum.

Figure 15:
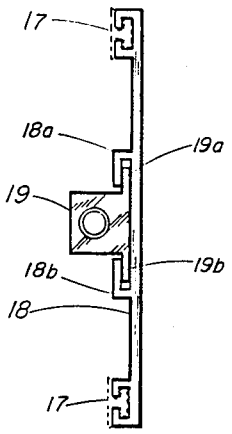
FIG. 15 is an end view of the clamp bar portion of preferred embodiment of the apparatus of the present invention.
Figure 13:
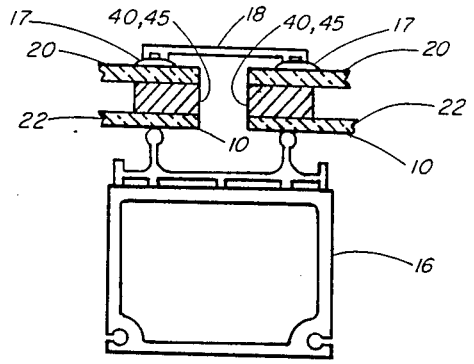
FIG. 13 is a sectional view of the preferred embodiment of the apparatus of the present invention illustrating assembly of two adjacent modular panels upon a structural supporting tube member.

Clamp bar 18 can be used to assemble multiple panels 10 upon a structural tubing member 16, as best seen in FIG. 13, by applying a load with clamp bar 18 to the sides of adjacent panels 10. Clamp bar 18 includes a threaded nut 19 attached by welding or by a mechanical fastener, for example, to the underside of clamp bar 18. Nut 19 threadably accepts bolt B which penetrates an opening in curb rail 15 (see FIG. 4). Clamp bar 18 has a pair of opposed guides 18*a*, 18*b* which extend longitudinally along at least a portion of clamp bar 18 and preferably along one end portion as shown in FIGS. 14 and 15. Threaded nut 19 includes opposed flanges 19*a*, 19*b* which register with guides 18*a*, 18*b* as shown in FIG.

15. This allows nut 19 to slideably move along clamp bar 18 in a longitudinal direction. This effectively provides an adjustment at one end portion of clamp bar 18 which aids in field installation. Thus, a clamp bar could have some adjustability for a given installation. For example, in the clamp bar 20 feet long and field installation dictated a 19 foot length, the nut 19 could be slideably moved along the clamp bar 18 to the desired location and then mechanically affixed with respect to claim bar 18 using a weld, a mechanical fastener such as a rivet or the detent locks 19*c* shown in FIG. 14. These would simply be semi-circular recesses formed in flanges 19*a* and 19*b* so that a laborer could simply strike the guides 18*a*, 18*b* at the recesses 19*c* so that the guides would be bent and occupy the recesses 19*c* affixing the position of nut 19 with respect to the clamp bar 18. Clamp bar 18 can have gasket seals 17 at the edges (FIG. 15) to enhance even load distribution along panels 10. Gasket seals 17 also form a seal with panels 10. Any excess material of clamp bar 18 could be cut if desired at that time. This adjustability in combination with the aforedescribed modular panel provides a quick and easy field installation for the skylight panel apparatus of the present invention.

Figure 10:
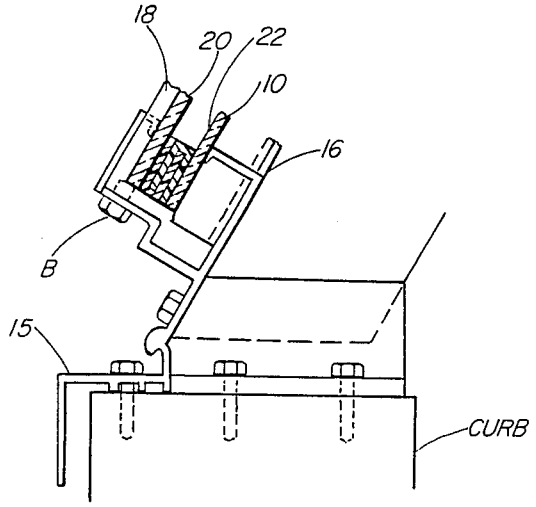
FIG. 10 is a sectional, elevational fragmentary view of the preferred embodiment of the apparatus of the present invention showing the curb rail and modular panel and illustrating a structural barrel vault.
Figure 11:
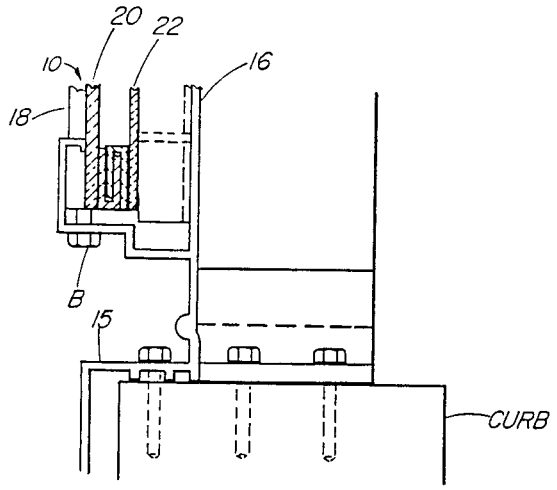
FIG. 11 is a sectional, elevational fragmentary view of the preferred embodiment of the apparatus of the present invention illustrating use with a half round or quarter round vault.
Figure 12:
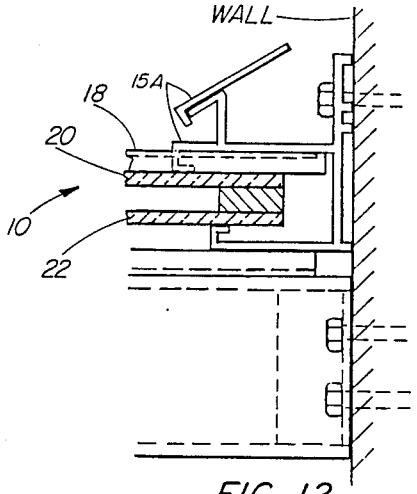
FIG. 12 is a sectional, elevational fragmentary view of the preferred embodiment of the apparatus of the present invention illustrating use with a quarter round vault.

In FIGS. 10–13, modular panel 10 is illustrated in a variety of applications. FIG. 10 illustrates a structural barrel vault showing a supporting curb of concrete, wood or steel, the curb rail 15, and the angularly extending tubing frame 16 with sheets 20, 22 of modular panel 10 shown in position upon the frame 16 and secured by clamp bar 18. FIGS. 11 and 12 show the lowermost and uppermost connections of modular panel 10 to a quarter round or half round vault (FIG. 11) illustrating the supporting curb, the curb rail 15, tubing frame 16, and modular panel 10 secured by clamp bar 18. In FIG. 12, the uppermost portion of a quarter round vault (FIG. 3) is shown illustrating a top rail 15*a* to which is secured modular panel 10 with clamp bar 18, the top rail being connected to a wall.

In FIG. 13, a transverse tubing member 16 is shown receiving the two end portions of modular frames 10 with clamp bar 18 in position.

The foregoing description of the invention is illustrative and explanatory thereof, and various changes in the size, shape and types of materials, as well as in the details of the illustrated construction, may be made without departing from the spirit of the invention and the scope of the claims.

What is claimed as invention is:

1. A vaulted skylight panel apparatus comprising:

a. a pair of first and second spaced apart sheets with an airspace therebetween, that can be simultaneously curved by cold forming from a substantially flat to a curved position;

b. frame means carried by the sheets for supporting the sheets with respect to each other at a desired spacing and including first and second frame members affixed respectively to the first and second panels; and c. connection means including interconnected portions of the frame means for holding the first and second frame members together during simultaneous cold forming of the first and second sheets from an initial substantially flat position to a curved position wherein the interconnected portions include portions which move with respect to each other.

2. The vaulted skylight panel apparatus of claim 1 wherein the first sheet is longer than the second sheet and the sheets are substantially parallel to each other.

3. The vaulted skylight panel apparatus of claim 1 wherein the connection means includes a pair of abutting flanges which slide upon one another when the sheets are simultaneously cold formed from a substantially flat to a curved position.

4. The vaulted skylight panel apparatus of claim 3 wherein the first and second frame members each comprise a generally U-shaped structural section.

5. The vaulted skylight panel apparatus of claim 1 further comprising stop means for registering the first and second frame members in a rest position wherein the sheets are in a generally parallel flat unformed position.

6. The vaulted skylight panel apparatus of claim 1 wherein the frame means and connection means form a seal that inhibits the accumulation of debris in the airspace.

7. A vaulted skylight apparatus comprising:

a. a peripheral rail, defining lateral dimensions of the vaulted skylight apparatus and adapted for placement upon an underlying structural base support, and including at least a pair of spaced apart opposite, rail support members;

b. a plurality of curved, spaced structural supports extending between the opposite side rail support members, each being correspondingly shaped to define the vaulted skylight apparatus cross-section;

c. at least one skylight panel, extending between opposite side rails, and being conformable to the structural supports by cold forming;

d. a tensionable strap means for holding the sheets upon the structural supports and including an elongated strap that lies on one surface of the skylight panel, so that the strap and structural support sandwich the skylight panel therebetween;

e. a pair of opposed guides extending longitudinally along at least a portion of the strap f. fastener means mounted for travel upon the guides;

g. means for affixing the fastener means with respect to the strap means; and h. means for applying tension to the strap means at the fastener means.

8. The vaulted skylight apparatus of claim 7 wherein the structural supports are curved.

9. The vaulted skylight apparatus of claim 7 wherein the skylight panels are peripherally sealed to inhibit the accumulation of debris in the airspace between the panels.

10. The vaulted skylight apparatus of claim 7 wherein the skylight panels each comprise a pair of spaced apart sheets connected peripherally with a dust seal that allows a movement between the sheets when the sheets are cold formed into a curved vaulted position.

* * * * *